US006250569B1

(12) United States Patent
Taccon

(10) Patent No.: US 6,250,569 B1
(45) Date of Patent: Jun. 26, 2001

(54) ADJUSTABLE SPRAYING HEAD

(75) Inventor: Danizzo Taccon, Sesto San Giovanni (IT)

(73) Assignee: Tacoon Costruzioni Meccaniche di Girona A. & Taccon D. S.N.C., Sesto San Giovanni (IT)

( * ) Notice: Subject to any disclaimer, the term of this patent is extended or adjusted under 35 U.S.C. 154(b) by 0 days.

(21) Appl. No.: 09/524,556

(22) Filed: Mar. 13, 2000

(30) Foreign Application Priority Data

Mar. 12, 1999 (IT) ..... MI99A0514

(51) Int. Cl.[7] ..... B05B 7/12; F02M 61/10
(52) U.S. Cl. ..... 239/407; 239/533.11; 239/408
(58) Field of Search ..... 239/536, 533, 239/583, 584, 533.15, 407, 412, 418, 426, 433, 434, 411, 533.11, 408; 251/28; 157/88

(56) References Cited

U.S. PATENT DOCUMENTS 3,680,781 * 8/1972 Lincoln ..... 239/431
4,076,173 * 2/1978 Taccon et al. ..... 239/411
4,344,919 * 8/1982 Kelterbaum ..... 422/133
5,340,026 * 8/1994 Woodruff ..... 239/104
5,655,691 * 8/1997 Stern et al. ..... 239/391
5,683,037 * 11/1997 Rochman et al. ..... 239/536

* cited by examiner

*Primary Examiner*—David A. Scherbel
*Assistant Examiner*—Davis Hwu
(74) *Attorney, Agent, or Firm*—Young & Thompson

(57) ABSTRACT

A spraying head for feeding pressurized air and an atomized liquid substance, for example a releasing agent, for cleaning and treatment of molds in hot molding of ferrous and non-ferrous materials; the spraying head comprises a main body having at least a mixing chamber in which a first conduit for the injection of pressurized air opens on a side opposite to a spraying nozzle; a second conduit for feeding a liquid, opens into the mixing chamber through a Venturi which tapers towards the same mixing chamber, at right angle to the air injection conduit. A normally closed control valve is slidably supported inside a flow regulator having a tapering end portion protruding into the Venturi, to regulate the delivery of the liquid substance into the mixing chamber; the spraying head may be provided with a single or independent spraying nozzles and mixing chambers on opposite sides of the main body.

11 Claims, 3 Drawing Sheets

ADJUSTABLE SPRAYING HEAD

BACKGROUND OF THE INVENTION

The present invention relates to a spraying head suitable for spraying pressurized air and/or an atomized liquid, for example a washing liquid and/or a releasing agent, inside foundry molds or molds for plastic materials, and more precisely relates to a single or to a double head designed to selectively spray, in a controlled manner, pressurized air and/or an atomized liquid from one or both sides, inside molds for casting ferrous and non-ferrous materials.

In many areas of application, in particular in the foundry field, there is the need to spray pressurized air and/or atomized liquids into the cavities of open molds, so as to clean them or to apply a suitable releasing agent.

Single spraying heads are currently used and fastened to an arm of a manipulator, which require the head to be oriented towards the cavities of each of the two half-molds to be cleaned and/or to be treated.

The use of single heads, and the need to direct them towards the two half-molds, entails certain problems and a complexity of movements, both in small and large sizes molds, as well as excessively long down times between the various molding steps.

In molds having a complex configuration, or in cases wherein rapid work with the spraying heads is required, the use of the conventional spraying heads has therefore proved to be limiting and wholly unsuitable for fulfilling the various needs, preventing the high efficiency of the head and broad freedom of movement. Furthermore, the spraying heads presently in use do not allow for a proper adjustment of liquid to be sprayed and a selective feeding of atomized liquid and pressurized air into a mold.

OBJECTS OF THE INVENTION

The main object of the present invention is to provide a spraying head suitable for selectively ejecting pressurized air and/or an atomized liquid substance, for example a releasing agent or another type of liquid inside an open mold, or for other applications, which is highly effective and easy to use.

A further object of the invention is to provide a single or a double spraying head by means of which it is possible to work on one or on opposite sides extremely rapidly, without having to perform excessively complex movements in order to spray the internal cavities of a mold.

Yet a further object of the present invention is to provide a spraying head of the type mentioned above, by means of which it is possible to selectively feed pressurized air and/or an atomized liquid substance preventing, in the absence of pressurized air, the spraying head from leaking and therefore soiling the machine or the area below.

Yet another object of the present invention is to provide a spraying head suitable for spraying pressurized air and/or a treatment liquid, independently in one or in two opposite directions, maintaining the same head extremely small in size and with minimum bulk.

BRIEF DESCRIPTION OF THE INVENTION

According to a first aspect of the invention a spraying head has therefore been provided for selectively generating a jet of pressurized air and of an atomized liquid substance, comprising:

a main body having at least a first mixing chamber and a spraying nozzle;

first conduit means for injection of pressurized air into the mixing chamber on a side opposite to the spraying nozzle;

second conduit means for feeding the liquid substance, said second conduit means comprising a converging portion to define a Venturi which tapers towards the mixing chamber, at right angles to the air injection conduit; and an actuable, normally closed control valve for said second conduit, said control valve being slidably movable in respect to a flow regulator having a tapered end portion protruding into the Venturi to adjustably restrict the flow path.

According to another aspect of the invention, the control valve comprises an air pressure actuated valve member, coaxially arranged inside the flow regulator; the valve member is provided at the front end of a control stem which extends at the rear to the regulator, to a piston of a single-acting cylinder, and a thrust spring, to bias the valve member backwards in the Venturi, for opening the passage for the liquid. The use of an angularly orientable distributor for the pressurized air to the cylinder of the control valve, which can be angularly oriented around the longitudinal axis of the flow regulator, allows all the inlets of the pressurized air and of the liquid substance to be arranged on a same side of the main body of the spraying head.

BRIEF DESCRIPTION OF THE DRAWINGS

These and further features of a spraying head according to the invention, will be made clearer by the following description with reference to the accompanying drawings, in which.

DETAILED DESCRIPTION OF THE INVENTION

Figure 1:
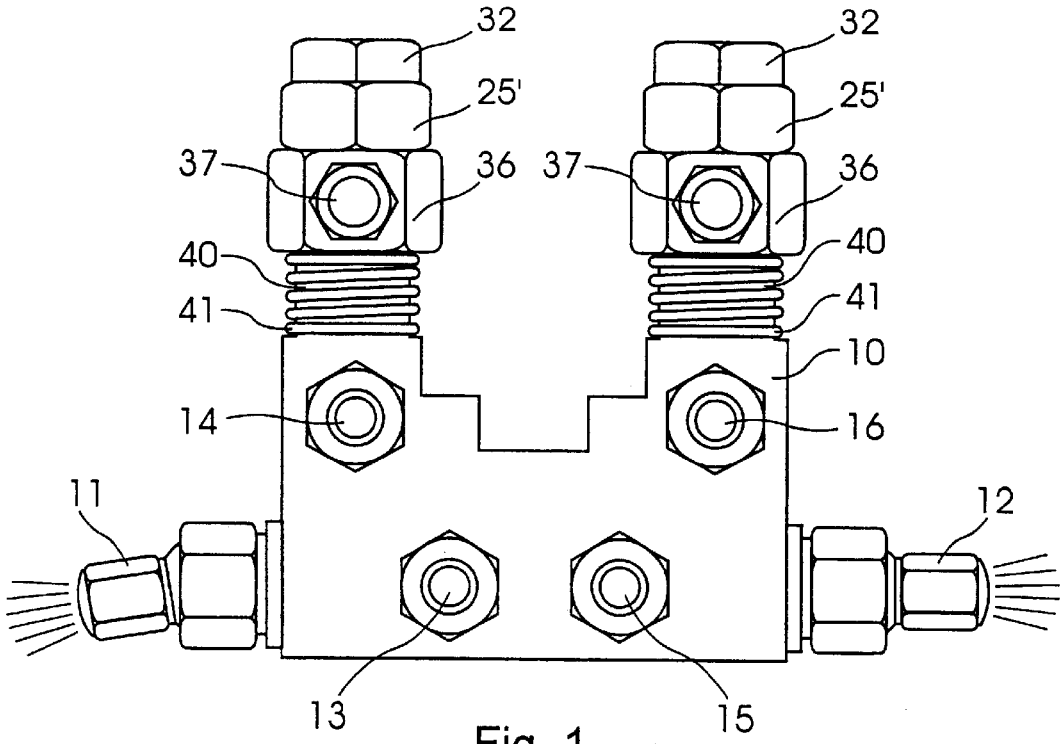
FIG. 1 is a front view of a double spraying head.
Figure 2:
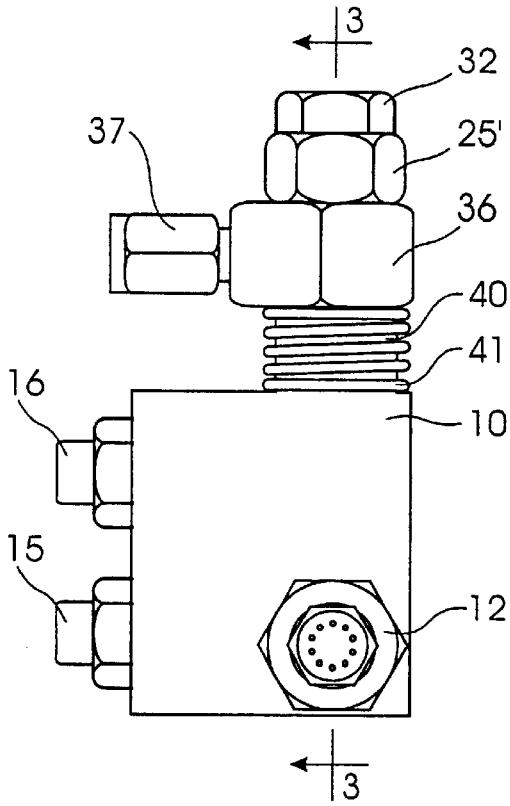
FIG. 2 is a side view of the head of FIG. 1.

The invention will be now described with reference to a double spraying head, nevertheless it is also applicable to a single spraying head, where necessary.

As shown in the various figures, the spraying head comprises a main body 10, for example made by a metal block with a rectangular shape, provided on two opposite sides with a first nozzle 11 and a second nozzle 12 which can be appropriately oriented angularly through 360° and in every direction, by means of a ball joint.

Reference 13 in the various figures denotes a first inlet conduit for pressurized air, while reference 14 denotes a second inlet conduit for a liquid substance to be atomized into a mixing chamber 19, to be sprayed by the first nozzle 11; at the same time reference 15 denotes the inlet for air and 16 the inlet for a liquid to be atomized into a mixing chamber 20, and to be sprayed from the second nozzle 12.

Figure 3:
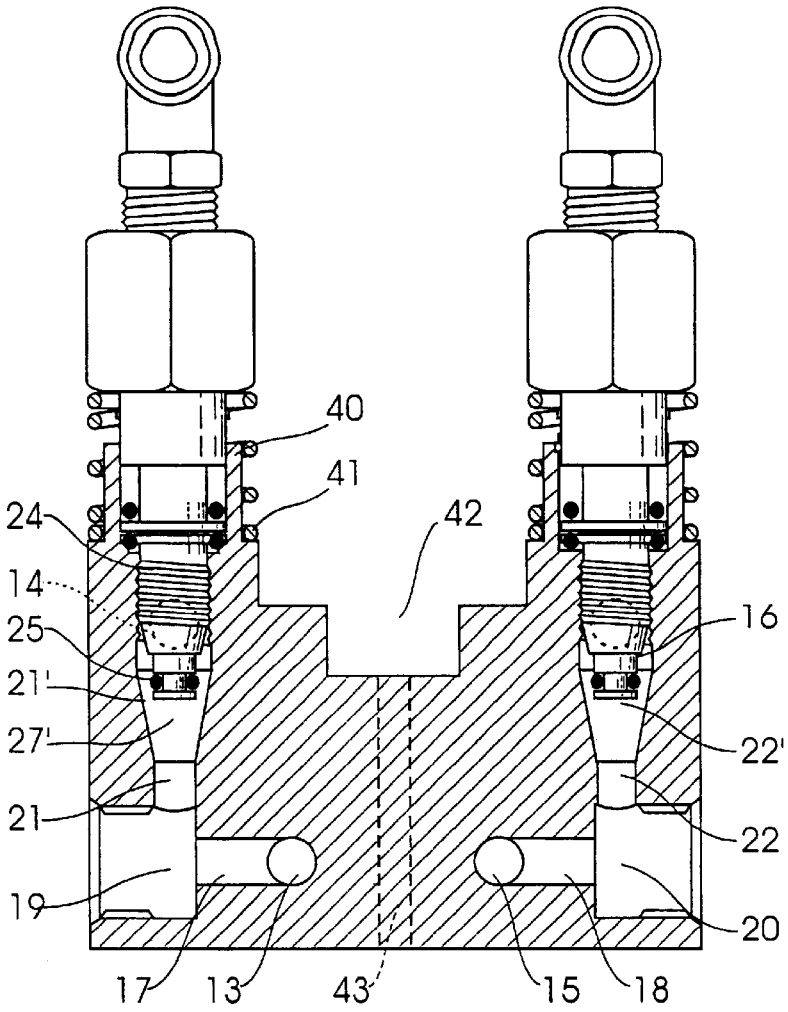
FIG. 3 is an enlarged cross-sectional view, along line 3—3 of FIG. 2.

As can be seen from FIG. 3, each inlet 13 and 15 for the air communicates with a respective conduit 17 and 18 arranged at 90°, which opens towards the respective mixing chamber 19 and 20 on the side opposite to the spraying nozzles 11 and 12.

Contrarily, each inlet 14 and 16 for the liquid communicates with the respective mixing chamber 19 and 20 (FIG. 3) via a second feeding conduit 21, 22, comprising a converging portion 21, 22' defining a Venturi tapering toward and at right angles to the conduit 17 and 18 for the pressurized air.

In particular, as shown on the left side of FIG. 3, each conduit 21 and 22 for the liquid is provided with a normally closed valve inside a flow regulator 24; the regulator has a body with a conical end portion 25 which extends into the Venturi 21', 22' so as to form an adjustable annular passage for the liquid flow, through 360°, and in a direction converging towards the mixing chamber 19.

The body of the regulator 24 is also provided near the conical surface 25, with a threaded portion 26 which screws into a corresponding threaded hole of the body 10 of the head, which is aligned with the conduit 21 or 22 for the fluid, as shown in the left part of FIG. 3.

Figure 5:
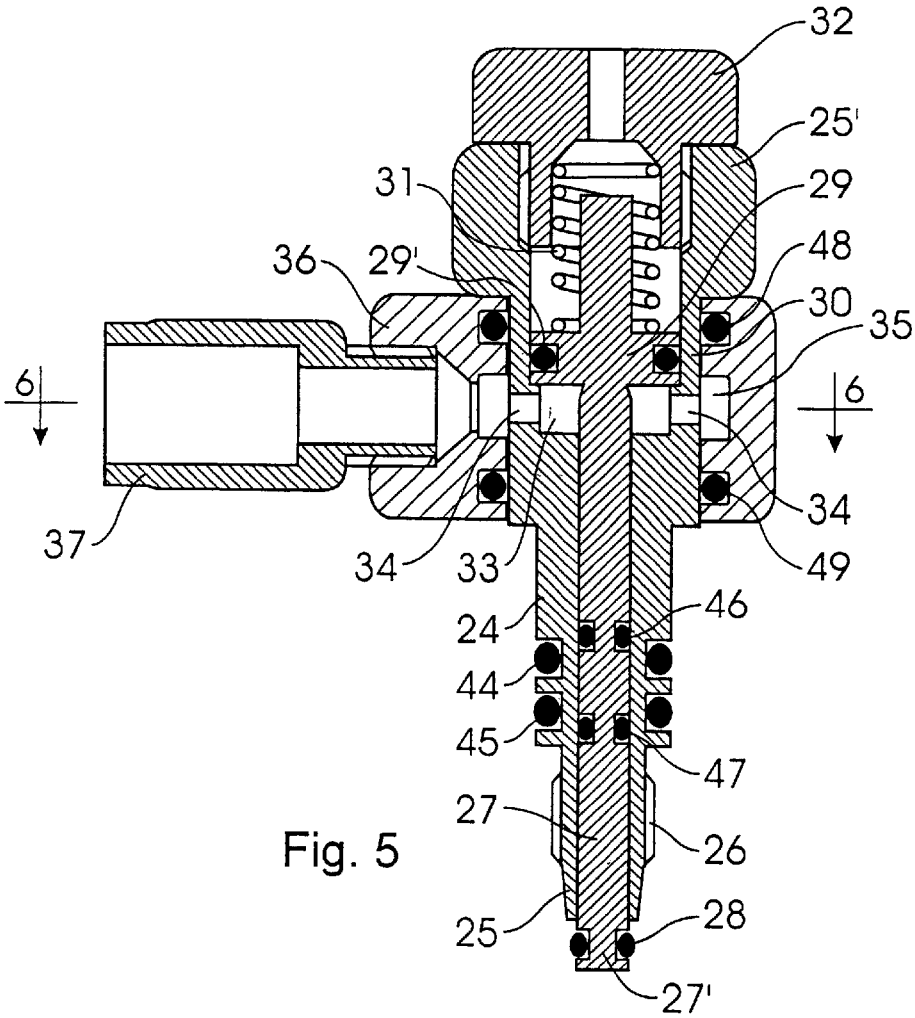
FIG. 5 is an enlarged sectional view of the regulator and the control valve.
Figure 6:
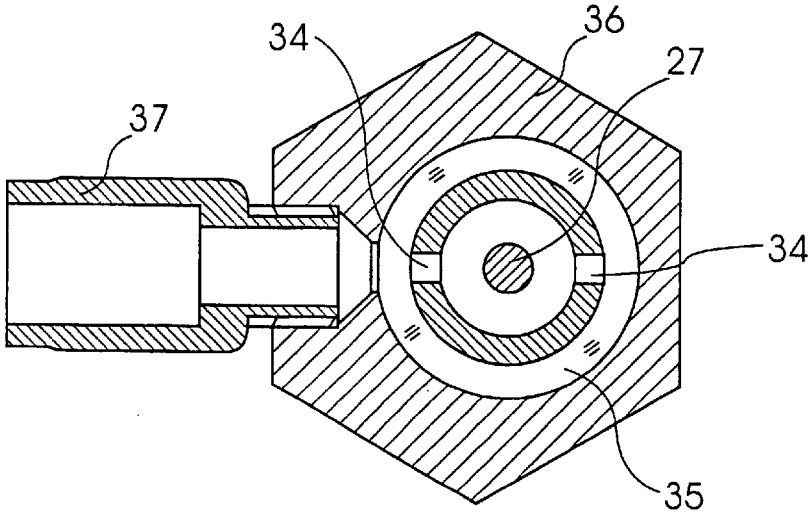
FIG. 6 is a cross-sectional view along line 6—6 of FIG. 5.

The body of the regulator 24, as shown in FIG. 5, comprises an axially movable stem 27 having a valve member 27' at the fore end, which protrudes slightly from the body 24 and is provided with an annular groove for an O-ring 28 designed to seal against the conical surface of the Venturi 21', or 22' respectively. The stem 27 is also provided with two guide and sealing O-rings 46, 47 in a central position.

The stem 27 in turn extends at the rear, towards a piston 29 comprising an O-ring 29' to slide in a single-acting pneumatic cylinder 30, provided in a widened rear portion of the body 24 of the regulator. By acting on the rear portion 25' to turn the regulator, it is possible to throttle the passage for the liquid into the Venturi 21, 22' to adjust the flow rate of the liquid fed into the mixing chamber 19, 20 to be atomized by the air injected by the conduit 17 or 18

A thrust spring 31 acts on the opposite side of the piston 29, being arranged around an extension of the stem 27, in the rear chamber of the cylinder which is closed by a plug 32.

The bottom of the chamber 33 of the cylinder for actuating the control valve (FIG. 5) is fed with pressurized air through radial openings 34 in the body 24 of the regulator, as well as through an annular channel 35 into an air distributor 36 which can be turned and oriented through 360°, and provided with a coupling 37 for the connection to a pressurized air source. Reference 48 and 49 also denote two guide and seal gaskets for the air distributor.

Figure 4:
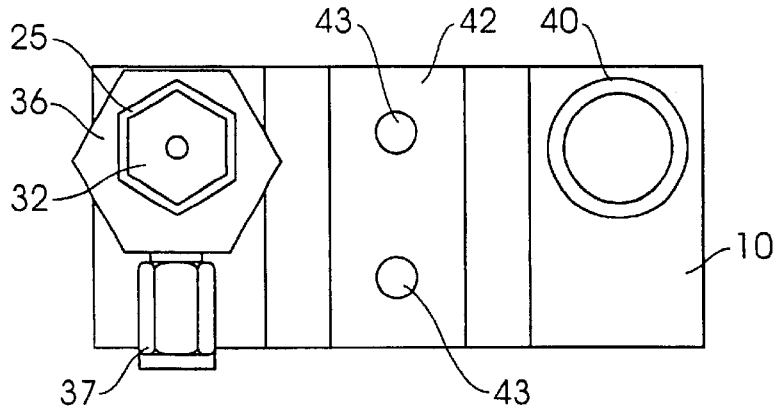
FIG. 4 is a top view of FIG. 3.

FIGS. 3 and 4 show another feature of the spraying head according to the present invention. As can be seen from said figures, the body 24 of the regulator extends sealingly upwards via a tubular portion 40 of the body 10, which is surrounded by a helical spring 41 resting between a shoulder surface of the distributor 36, and a shoulder of the body 10. The spring 41 prevents loosening of the distributor 36, avoiding air leaks, and at the same time allows the body 24 to be maintained in a correct position.

Again from FIGS. 3 and 4, it can be seen finally that the body 10 of the spraying head is provided above with a cross-groove 42 having threaded holes 43 for the attachment of the head body 10 to an arm of a manipulator.

The operation of the spraying head is practically the following: it is assumed that initially the two control valves are closed and the regulators are adjusted in a position according to the required flow rate for the liquid, and that feeding of the pressurized air has stopped. In these conditions, no flow of pressurized air or jet of atomized liquid will be ejected from the two nozzles 11 and 12 of the spraying head, in that each valve member 27' at the front end of the stem 27 is forced to close against the conical surface inside the Venturi 21' and 22' due to the thrust exerted by the spring 31.

It is also assumed that the head, in these conditions, is disposed between the two halves of an open mold, to perform a cleaning operation with pressurized air and spraying with a releasing agent.

By maintaining the head 10 adjacent to one of the two half-molds, with the control valves closed, it is firstly possible to feed pressurized air for example into the chamber 19 via the conduit 17, to generate a jet of air maintaining the nozzle 11 appropriately oriented towards the cavity of one of the two half-molds. During spraying of pressurized air, the head 10, by means of a manipulator managed by an electronic control unit, can be moved in a programmed manner to clean the whole surface of the cavity or cavities of the half-mold, hitting it with a jet of pressurized air.

Having ended the cleaning operation of the half-mold with pressurized air, it is now possible to spray the releasing agent with the same nozzle 11. In this case pressurized air is fed into the bottom chamber of the cylinder 30 so that piston 29 causes the stem 27 and valve member 27' to move backwards to open the Venturi 21'. Simultaneously pressurized air is fed into the mixing chamber 19 via the conduit 17 and the inlet 13. This flow of air, due to the vacuum created in the Venturi 21', will aspirate a flow of releasing agent which will be mixed with the pressurized air in an atomized form to be sprayed by the nozzle 11 against the mold. At the end of this operation, feeding of the pressurized air will be stopped at both inlets 13 and 37 of the head, causing the forward movement of the stem 27 and valve member 27' pushed by the spring 31, to close the control valve against the conical surface of the Venturi, in this way interrupting the jet of air and of atomized liquid.

Having completed the cleaning operation and the application of the releasing agent in the first half-mold, the head 10 can now be simply moved horizontally and/or vertically towards the other half-mold for a similar cleaning operation and/or application of the releasing agent by pressurized air and atomized liquid sprayed by means of the nozzle 12.

In the previous example a double spraying head has been described having two independent side nozzles and control valves which can be selectively actuated to spray pressurized air and/or a treatment liquid inside the cavities of an open mold. In this way a spraying head is provided, with a compact shape and extremely small size, having functionally independent nozzles, by means of which it is possible to operate also in extremely small spaces by performing simple lateral and/or vertical movements.

The quantity of sprayed liquid can also be changed between a minimum and a maximum by adjusting the regulator 24 by screwing or unscrewing partially the same, to advance or retract in respect to the conical surface of the Venturi 21' or 22'.

The invention is also applicable, where necessary to a single nozzle head; therefore what has been said and shown with reference to the drawings has been given purely by way of an example of the general features of the invention.

What I claim is:

1. Spraying head for selectively generating a jet of pressurized air and of an atomized liquid substance, comprising:

a main body having a first mixing chamber and a spraying nozzle;

first conduit means for injection of pressurized air into said mixing chamber on a side opposite to said spraying nozzle;

second conduit means for feeding a liquid substance, said second conduit means comprising a converging portion to define a conduit portion which tapers towards and opens directly into said mixing chamber, at right angles to said first conduit means;

a flow regulator extending into said tapered conduit portion;

an actuable, normally closed control valve for said second conduit means, said control valve being coaxially arranged and slidably protruding from said flow regulator; and pressure actuated valve control means to move said control valve between a retracted position which opens said second conduit means and an advanced position into said tapered conduit portion which closes said second conduit means.

2. Spraying head according to claim 1, wherein said control valve comprises an air pressure actuated valve member, and biasing means to urge said valve member to close said second conduit means.

3. Spraying head according to claim 1, further comprising means for angularly orienting said spraying nozzle.

4. Spraying head according to claim 2, wherein said valve memberis connected to a piston of a pneumatic control cylinder, said control cylinder being connected to a pressurized air source by an angularly orientable air distributor.

5. Spraying head according to claim 4, wherein the control cylinder is provided in a rear extension of the body of the flow regulator.

6. Spraying head according to claim 4, wherein the air distributor comprises an annular channel opening into the chamber of the control cylinder through radial passages.

7. Spraying head according to claim 1, wherein said first and second conduit means are arranged on a same side of the spraying head.

8. Spraying head according to claim 1, further comprising means for axially adjusting said flow regulator.

9. Spraying head according to claim 4, further comprising a helical spring between a shoulder on said body and a shoulder of said air distributor.

10. Spraying head according to claim 1, further comprising a cross-groove having threaded holes in said body for attachment to an arm of a manipulator.

11. Spraying head for selectively generating jets of pressurized air and of atomized liquid substances, comprising:

a main body having first and second mixing chambers and spraying nozzles arranged on opposite sides;

first conduit means for injection of pressurized air into each mixing chamber, on a side opposite to each spraying nozzle;

second conduit means for feeding a liquid substance in each mixing chambers, said second conduit means comprising a converging portion to define a conduit portion which tapers towards and opens directly into said mixing chamber, at right angles to said first conduit means;

a flow regulator extending into said tapered conduit portion of each of said second conduit means;

an actuable, normally closed control valve in each of said second conduit means, said control valve being coaxially arranged and slidably protruding from each flow regulator; and pressure actuated valve control means to move each control valve between a retracted position which opens each of said second conduit means and an advanced position into each tapered conduit portion which closes each of said second conduit means.

* * * * *